United States Patent [19]

Wachtel

[11] Patent Number: 4,480,234

[45] Date of Patent: Oct. 30, 1984

[54] GYROTRON BACKWARD WAVE OSCILLATOR DEVICE

[75] Inventor: Jonathan M. Wachtel, Rechovot, Israel

[73] Assignee: Elta Electronics Industries Ltd., Ashdod, Israel

[21] Appl. No.: 303,604

[22] Filed: Sep. 18, 1981

[30] Foreign Application Priority Data

Dec. 9, 1980 [IL] Israel ..... 61680

[51] Int. Cl.[3] ..... H01J 25/46; H01J 25/00

[52] U.S. Cl. ..... 331/82; 331/86; 330/4

[58] Field of Search ..... 331/79, 82, 86, 96; 330/4

[56] References Cited

U.S. PATENT DOCUMENTS

| | | | |
|---|---|---|---|
| 3,398,376 | 8/1968 | Hirshfeild | 331/79 |
| 4,038,602 | 7/1977 | Friedman | 331/82 |
| 4,224,576 | 9/1980 | Granatstein et al. | 330/4 |
| 4,263,566 | 4/1981 | Guenard | 331/82 |
| 4,345,220 | 8/1982 | Sullivan | 331/79 |
| 4,395,655 | 7/1983 | Wurthman | 331/79 |

*Primary Examiner*—John S. Heyman

*Attorney, Agent, or Firm*—Benjamin J. Barish

[57] ABSTRACT

A gyrotron backward wave oscillator device is described which can be operated in a controlled and predictable manner. The device includes an evacuated waveguide section, an electron source at one end providing a spiral electron beam, a collector at the opposite end, means for producing a magnetic field parallel to the longitudinal axis of the waveguide section, and an output window, the parameters of the device being such as to support backward wave oscillation therein and to output same through the window.

4 Claims, 1 Drawing Figure

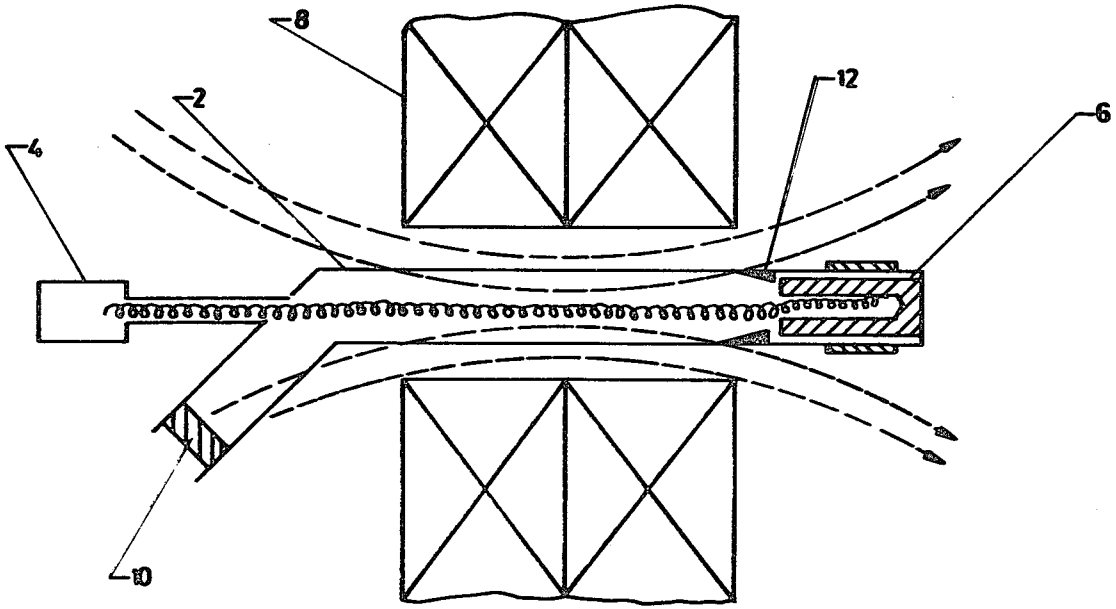
9
12
8
2
7
10

GYROTRON BACKWARD WAVE OSCILLATOR DEVICE

BACKGROUND OF THE INVENTION

The present invention relates to gyrotron backward wave oscillator devices.

The electron cyclotron maser instability has been exploited as the basis for a new high power millimeter-wave tube called the gyrotron. The gyrotrons that have been developed include cavity oscillators, travelling wave amplifiers, and multi-cavity gyro-klystrons; and a number of studies describing the design and operation of such devices have been published. See, for example, V. A .Flyagin, A. V. Gapunov, M. I. Petelin and V. K. Yulpatov, IEEE Trans. Microwave Theory and Tech. MTT-25, 514 (1977); K. R. Chu, Phys. Fluids 21, 2354 (1978); Kwo Ray Chu, A. T. Drobot, V. L. Granatstein and J. L. Seftor, IEEE Trans. Microwave Theory and Tech. MTT-27, 178 (1979); and J. L. Seftor, V. L. Granatstein, Kwo Ray Chu, P. Sprangle and M. E. Read, IEEE J. Quant. Elec., QE-15, 848 (1979). However, the design of an operable and predictable gyrotron backward wave oscillator has not yet been achieved, insofar as we are aware, although gyrotron backward wave oscillations have been observed as an undesirable effect. Yet the design of an operable gyrotron backward wave oscillator which can be operated in a controlled and predictable manner as regards frequency output, is obviously desirable since such an oscillator would provide a high power source of radiation in the microwave and millimeter wave frequency region tunable over the entire useful frequency range of a waveguide mode.

An object of the present invention is to provide a gyrotron backward wave oscillator device which can be operated in a controlled and predictable manner.

BRIEF SUMMARY OF THE INVENTION

According to a broad aspect of the present invention, there is provided a gyrotron backward wave oscillator device characterized in that it includes: an evacuated waveguide section; an electron source at one end of said waveguide section providing a spiral electron beam; a collector at the opposite end of said waveguide section; means for producing a magnetic field parallel to the longitudinal axis of said waveguide section; and an output window at said one end of the waveguide section, the parameters of the device being such as to support backward wave oscillation therein and to output same through said window.

More particularly, the parameters of the gyrotron backward wave oscillator device are such that it operates above any one of the thresholds defined by the following relationships:

B=magnetic field strength (field parallel to axis)-(webers/m$^2$);
I=electron beam current (amps);
A=waveguide cross-section area (m$^2$);
q=electron beam shape factor (form factor);
f=desired operating frequency (Hz);
$f_{co}$=waveguide cutoff frequency (Hz);
$v_{18}$=electron beam velocity parallel to axis (m/sec);
$v_\perp$=electron beam velocity perpendicular to axis (m/sec);
m=mass of electron (kgm);
e=charge of electron (coulomb);
C=speed of light in vacuum (m/sec);
$\epsilon_o$=permitivity of vacuum (farad/m); and
G and H define "gain" and "detuning" parameters, respectively, and have the following relative relationships for the various thresholds of oscillation;

| | | | | | |
|---|---|---|---|---|---|
| G | .292 | .781 | 1.269 | 1.765 | . . . |
| H | .221 | .705 | 1.184 | 1.666 | . . . |

TECHNICAL ANALYSIS

An analysis is provided herein of backward wave oscillation due to the cyclotron maser instability, from which analysis we derived the values of the above two parameters, namely, "G" and "H", which predict the thresholds of backward wave oscillation. This analysis follows the method of the theory of backward wave oscillation in longitudinal space charge wave travelling wave tubes.

Thus, take the simple case of wave propagation parallel to a constant magnetic field in a waveguide consisting of two flat, perfectly conducting plates at $x=\pm a$. An electron beam flows along z in the direction of the magnetic field. In the absence of wave fields that perturb the electron motion, the beam is completely "cold" with rotational velocity $v_\perp$ randomly distributed in phase about the magnetic field and with velocity $v_\sim$ of the guiding centers parallel to the magnetic field. All of the guiding centers are confined to the $x=0$ midplane. The beam current and electron density are considered to be sufficiently small to disregard the nonself-consistent features of the beam equilibrium.

The electron beam and the waveguide independently support oscillations described respectively by the dispersion relations $$\omega = k_\sim v_\sim + \Omega \qquad \text{Eq. (2a)}$$

and $$\omega^2 = c^2 k_\perp^2 + c^2 k_\sim^2. \qquad \text{Eq. (2b)}$$

$$L = G\left[\left(\frac{16\pi^2 E_0 m C^4}{e}\right)\left(\frac{qA}{I}\right)\left(\frac{v_\parallel^3}{v_\perp^2(C^2 - v_\perp^2 - v_\parallel^2)^{\frac{1}{2}}}\right)\frac{(f^2 - f_{CO}^2)^{\frac{1}{2}}}{f_{CO}^2}\right]^{\frac{1}{3}} \qquad \text{Eq. (1a)}$$

$$B = \frac{2\pi m C}{e}(C^2 - v_\perp^2 - v_\parallel^2)^{-\frac{1}{2}}\left[f + \frac{v_\parallel}{C}(f^2 - f_{CO}^2)^{\frac{1}{2}} + H\left(\frac{v_\parallel}{L}\right)\right] \qquad \text{Eq. (1b)}$$

wherein:
L=length of tube waveguide section (meters);

The cutoff frequency for the waveguide mode is $ck_\perp$, $\Omega$ is the relativistic cyclotron frequency for electrons of energy $\gamma mc^2 = mc^2(1 - v_\perp^2/c^2 - v_\sim^2/c^2)^{-\frac{1}{2}}$ and $k_\sim$ is the propagation constant along z. In the interacting system the coupling between the beam cyclotron mode and the waveguide mode is strong when the Doppler shifted cyclotron frequency is close to the frequency of the waveguide mode. This occurs in the neighborhood of the points of intersection of Eqs. (2a) and (2b). Depending upon the values of $k_\perp$, $\Omega$ and $v_{18}$ the intersections may lie in the same or in adjacent quadrants of the $\omega - k_{18}$ plane. In the latter case the group velocities of the two modes have opposite signs at one of the intersections. The implicity feedback existing in such a situation can lead to backward wave oscillation.

We can neglect the mixing of higher transverse waveguide modes and consider only the interaction at the fundamental cyclotron resonance frequency. The well known dispersion relation for the lowest TE mode is $$\omega^2 - c^2k_\perp^2 - c^2k_{\|}^2 = \frac{\omega_p^2}{\gamma}\left[\frac{\omega - k_{\|}v_{\|}}{\omega - k_{\|}v_{\|} - \Omega} - \tfrac{1}{2}\beta_\perp^2\frac{\omega^2 - c^2k_{\|}^2}{(\omega - k_{\|}v_{\|} - \Omega)^2}\right], \quad \text{Eq. (3)}$$

where $\omega_p=(4\pi\theta e/2ma)^{\frac{1}{2}}$ is an effective plasma frequency for the beam, $\sigma$ is its surface charge density, $k_\perp=\pi/2a$ and $\beta_\perp=v_\perp/c$. The total field is written as the sum of four modes, each corresponding to a complex value of the propagation constant $k_{18}$ that satisfies Eq. (3) for real $\omega$. This form is suitable for the solution of the steady state boundary value problem that we treat. The longitudinal magnetic field for the mode sum is $$B_z = \sum_j B_{oj}\cos k_\perp(x - a)\exp(ik_{\|j}z) \quad \text{Eq. (4)}$$

where $B_{oj}$ are the mode amplitudes and the common time dependence $\exp(-i\omega t)$ is understood.

Boundary conditions are defined by considering that the fields are terminated in non-reflecting absorbing regions at $z<0$ and $z>L$ and that the unperturbed electron beam enters with $v_\sim>0$ at $z=0$. At $z=0$ the total field amplitude is assumed to be $B_o$, Maxwell's equations are satisfied and the transverse electron current vanishes. These requirements are equivalent to three linear boundary conditions $$\sum_j B_{oj} = B_o \quad \text{Eq. (5a)}$$

$$\sum_j (\omega^2 - c^2k_\perp^2 - c^2k_{\|j}^2)B_{oj} = 0 \quad \text{Eq. (5b)}$$

$$\sum_j \left[\frac{\omega - k_{\|j}v_{\|}}{\omega - k_{\|j}v_{\|} - \Omega} - \tfrac{1}{2}\beta_\perp^2\frac{\omega^2 - k_{\|j}^2c^2}{(\omega - k_{\|j}v_{\|} - \Omega)^2}\right]B_{oj} = 0. \quad \text{Eq. (5c)}$$

The dispersion relation to Eq. (3) has three solutions near the intersection of Eqs. (2a) and (2b). Therefore Eqs. (5a,b,c) may be solved for the three corresponding amplitudes $B_{oj}$. The fourth mode is far from cyclotron resonance, it has no substantial effect on Eqs. (5b) and (5c) and simply adds a superposed, non-interacting wave to Eq. (5a).

The linear gain at $z=0$ for a signal injected at $z=L$ is $$\frac{B_z(0)}{B_z(L)} = B_o\left[\sum_{j=1}^{3} B_{oj}\exp(ik_{\|j}L)\right]^{-1}. \quad \text{Eq. (6)}$$

If the bracketed sum vanishes the linear gain is infinite and the system will enter into oscillation. We show that two parameters, one governing the strength of the cyclotron resonance interaction and the other proportional to a detuning of the constant magnetic field determine such threshold conditions for backward wave oscillation.

We substitute variables that reflect the small departures from $(\omega,k_o)$ the cyclotron resonance intersection and we include a small detuning $\Delta\Omega$ of the magnetic field. We let $\xi=(k_\sim-k_o)/k_o$ and $h=\Delta\Omega/k_ov_\sim$ and adopt the following ordering scheme:

$$\xi \sim h \sim \frac{\omega_p}{ck_o} \sim \epsilon$$

$$\beta_\perp \sim \beta_{\|} \sim \frac{\Omega}{ck_o} \sim \frac{k_\perp}{k_o} \sim 1$$

where the ordering parameter $\epsilon<<1$. Retaining terms in Eq. (3) to lowest order in $\epsilon$ that includes the effect of detuning the magnetic field we obtain the approximate dispersion relation $$\xi^3+2h\xi^2-g=0 \quad \text{Eq. (7)}$$

where $$g = \left(\frac{1}{2\gamma^{\frac{1}{2}}}\ \frac{\omega_p}{ck_o}\ \frac{k_\perp}{k_o}\ \frac{\beta_\perp}{\beta_{\|}}\right)^2.$$

Our ordering requires that $g^{\frac{1}{3}}<<1$. Similarly by retaining only the leading terms in Eqs. (5a,b,c) we obtain $$\sum_j B_{oj} = B_o, \quad \text{Eq. (8a)}$$

$$\sum_j \xi_jB_{oj} = 0, \quad \text{Eq. (8b)}$$

and $$\sum_j \frac{B_{oj}}{(\xi_j + b)^2} = 0. \quad \text{Eq. (8c)}$$

From Eq. (6) the condition for infinite gain is $$\sum_j B_{oj}\exp(i2\pi N\xi_j) = 0 \quad \text{Eq. (9)}$$

where $N=k_oL/2\pi$ is the interaction length in empty waveguide wavelengths. The above system of equations can be further reduced by scaling with respect to N and substituting the solution of Eqs. (8) for the coefficients in Eq. (9). It we let $u=NE$, $H=Nh$ and $G=Ng^{\frac{1}{3}}$ we arrive at our final form $$u^3+2Hu^2-G^3=0 \quad \text{Eq. (10a)}$$

and $$\sum_j (u_j + H)^2(u_k - u_l)\exp(i2\pi u_j) = 0, j \neq k \neq l \text{ are cyclic.} \quad \text{Eq. (10b)}$$

The $u_j$ in Eq. (10b) are the three roots of Eq. (10a). The real and imaginary parts of Eq. (10b) are two equations for the parameters H and G at the threshold of backward wave oscillation. Our ordering approximations are automatically satisfied by choosing N sufficiently large that $G << N$ provided that H is, at most, the same order of magnitude as G.

We have found several of the lowest oscillation threshold solutions by computing contours for vanishing real and imaginary parts of Eq.(10b) and accurately locating their crossing points in the H-G plane. The solutions occur when the gain parameter G assumes the values 0.292, 0.781, 1.269, 1.765, . . . etc; and when the detuning parameter H assumes the corresponding values 0.221, 0.705, 1.184, 1.666, . . . etc. Our search, extending over the range $0<G<2.5$, $-2.5<H<2.5$, showed that these solutions lie in a narrow band $H/G<(27/32)^{\frac{1}{3}}$. In the region $H/G \leqslant (27/32)^{\frac{1}{3}}$ Eq. (10a) has one real root and the field consists of a growing wave, a decaying wave and a wave of constant amplitude. Solutions with larger values of G appear to approach the line $H/G=(27/32)^{\frac{1}{3}}$ where two of the roots are equal. In that event it is evident from Eqs.(10b) and (4) that the total field must vanish everywhere to satisfy the boundary conditions. We found no solutions in the region $H/G>(27/32)^{\frac{1}{3}}$ where the propagation constants are real.

The threshold solutions assert that an electromagnetic field null exists at $z=L$ even though field energy propagates toward $z=0$. The values of H and G set the required phase and amplitude relationships for the three backward ($k_\sim<0$) modes. All of the energy necessary to maintain the field is provided by the electron beam and no external excitation is required.

If the physical parameters are varied, the null position and oscillation frequency will shift. For example, increasing the gain will move the position of a possible field null closer to $z=0$. However the requirements for threshold oscillation will be exceeded. Beyond threshold the oscillation frequency and power output are determined nonlinearly through saturation effects. Therefore, it is not useful to pursue the linear theory beyond the identification of the thresholds.

In practice a device would consist of an evacuated waveguide section attached at one end to an electron collector and an absorber for the forward electromagnetic wave. The electron beam enters at the other end where a non-reflecting vacuum window couples the backward wave to a load. In this simple configuration the gyrotron backward wave oscillator can function as a tunable microwave or millimeter wave source. The tuning range may cover the useful frequency range of a standard waveguide in its fundamental mode. Since $k_\perp/k_\sim$ is of the order of unity over most of this range, and since g is independent of $\Omega$, broad frequency tuning is accomplished by varying the magnetic field. Narrow range, fast frequency modulation may be obtained by varying $v_\sim$, although probably not without amplitude modulation because of the variation of g. As $\omega$ approaches the waveguide cutoff value $ck_\perp$, $k_\sim$ falls rapidly to zero and the expansion used in the theory is not valid.

It can be shown that the relationships discussed in the above analysis can be re-expressed in terms of engineering design parameters, as set forth in Eqs. (1a) and (1b) above, to define the various operating thresholds for a gyrotron backward wave oscillator device. The relationships defined in Eqs. (1a) and (1b) above are for the general case of a cylindrical waveguide section (i.e., one where its walls are parallel to its longitudinal axis) of any cross-sectional configuration.

The foregoing design criteria were previously unknown, as the theory had not been solved before the present invention, insofar as we are aware. The relationships set forth in Eqs. (1a) and (1b) above, which appear therefore to define for the first time the thresholds of operation of gyrotron backward wave oscillator devices, may be used as universal design parameters for designing any gyrotron backward wave oscillator device.

BRIEF DESCRIPTION OF THE DRAWING

The invention is herein described, by way of example only, with reference to the accompanying single FIGURE of drawings diagrammatically illustrating one form of gyrotron backward wave oscillator device constructed in accordance with the invention.

DESCRIPTION OF A PREFERRED EMBODIMENT

The gyrotron backward wave oscillator device illustrated in the drawing comprises an evacuated waveguide section 2 of metal, e.g. copper, having an electron gun 4 at one end producing a spiral electron beam, and a depressed collector at the opposite end to collect the electron beam. The device further includes a magnet 8 producing a magnetic field parallel to the longitudinal axis of the waveguide section 2, and an outlet window 10 for outputting the microwave radiation generated within the device. The illustrated device further includes an absorber 12, e.g., carbon-loaded ceramic, adjacent to the collector 6 for absorbing any forward propagated wave.

The device oscillates spontaneously at a frequency determined by the magnetic field and the flow velocity of the beam along the magnetic field. The collector 6 is depressed to recover unused beam energy. The electromagnetic radiation flows opposite to the direction of the beam and exits via the output window 10 near the electron gun 4.

Eqs. (1a) and (1b) set forth above include the two parameters which determine the design requirements, namely, the gain parameter "G" and the detuning parameter "H", which define the thresholds of oscillations of the device. It will be seen that the gain parameter "G" involves the energy, rotations and drift velocity of the beam, the beam current, and the length of the waveguide section; whereas, the detuning parameter "H" involves the frequency of oscillation and the strength of the magnetic field.

One example of a practical device would be an 8 KV, 0.4 A electron beam with $\beta_\perp/\beta_\sim=3$ in a standard 1.6 cm×0.8 cm rectangular waveguide. The lowest oscillation threshold occurs at 16.5 GHz when L is 7.8 cm. The magnetic field for exact backward wave cyclotron resonance is 6241 Gauss and the required detuning is 17 Gauss. For this relatively high gain device $G/N \simeq 0.08$ and the ordering scheme is approximately consistent.

While the invention has been described with respect to one preferred embodiment, it will be appreciated that many variations, modifications and other applications of the invention may be made.

What is claimed is:

1. A gyrotron backward wave oscillator device characterized in that it includes:

an evacuated waveguide section;

an electron source at one end of said waveguide section providing a spiral electron beam;

a collector at the opposite end of said waveguide section;

means for producing a magnetic field parallel to the longitudinal axis of said waveguide section; and an output window at said one end of the waveguide section, the parameters of the device being such as to support backward wave oscillation therein and to output same through said window; the parameters being such that the device operates above a threshold defined by the following relationships:

$$L = G\left[\left(\frac{16\pi^2 E_o m C^4}{e}\right)\left(\frac{qA}{I}\right)\left(\frac{v_{\parallel}^3}{v_{\perp}^2(C^2 - v_{\perp}^2 - v_{\parallel}^2)^{\frac{1}{2}}}\right)\frac{(f^2 - f_{co}^2)^{\frac{1}{2}}}{f_{co}^2}\right]^{\frac{1}{3}}$$

$$B = \frac{2\pi m C}{e}(C^2 - v_{\perp}^2 - v_{\parallel}^2)^{-\frac{1}{2}}\left[f + \frac{v_{\parallel}}{C}(f^2 - f_{co}^2)^{\frac{1}{2}} + H\left(\frac{v_{\parallel}}{L}\right)\right]$$

wherein:

L = length of tube waveguide section (meters);

B = magnetic field strength (field parallel to axis)-(webers/$m^2$);

I = electron beam current (amps);

A = waveguide cross-section area ($m^2$);

q = electron beam shape factor (form factor);

f = desired operating frequency (Hz);

$f_{co}$ = waveguide cutoff frequency (Hz);

$v_{\sim}$ = electron beam velocity parallel to axis (m/sec);

$v_{\perp}$ = electron beam velocity perpendicular to axis (m/sec);

m = mass of electron (kgm);

e = charge of electron (coulomb);

C = speed of light in vacuum (m/sec);

$\epsilon_o$ = permitivity of vacuum (farad/m); and

G and H define "gain" and "detuning" parameters, respectively, and have the following relative relationships for the various thresholds of oscillation:

| | | | | | |
|---|---|---|---|---|---|
| G | .292 | .781 | 1.269 | 1.765 | ... |
| H | .221 | .705 | 1.184 | 1.666 | ... |

2. The device according to claim 2, wherein its parameters are such that the device operates above the lowest one of the thresholds defined by said relationship.

3. The device according to claim 2, wherein said collector is depressed.

4. The device according to claim 2, further including an absorber adjacent to the collector for absorbing any forward propagated wave.

* * * * *

UNITED STATES PATENT AND TRADEMARK OFFICE

CERTIFICATE OF CORRECTION

PATENT NO. : 4,480,234

DATED : October 30, 1984

INVENTOR(S) : Jonathan M. WACHTEL

It is certified that error appears in the above-identified patent and that said Letters Patent is hereby corrected as shown below:

column 2, line 8, "$v_{18}$" should read --$v_{||}$-- column 2, line 40, "$v_{\sim}$" should read --$v_{||}$-- column 2, line 50, that portion of the formula reading "$k_{\sim} v_{\sim}$" should read --$k_{||} v_{||}$-- column 2, line 54, that portion of the formula reading "$k_{\sim}^{2}$" should read --$k_{||}^{2}$-- column 2, last line, that portion of the formula reading "$v_{\sim}^{2}$" should read --$v_{||}^{2}$--;

" " " " that portion of the formula reading "$k_{\sim}$" should read --$k_{||}$-- column 3, line 7, "$v_{18}$" should read --$v_{||}$-- column 3, line 9, "$k_{18}$" should read --$k_{||}$--

Column 3, line 11, "implicity" should read --implicit-- column 3, line 25, that portion of the formula reading "$\theta$" should read --$\sigma$-- column 3, line 29, "$k_{18}$" should read --$k_{||}$--

UNITED STATES PATENT AND TRADEMARK OFFICE

CERTIFICATE OF CORRECTION

PATENT NO. : 4,480,234

DATED : October 30, 1984

INVENTOR(S) : Jonathan M. WACHTEL

It is certified that error appears in the above-identified patent and that said Letters Patent is hereby corrected as shown below:

column 3, line 43, "$v_{\sim}$" should read --$v_{||}$-- column 3, line 60, after "relation" delete "to"

Column 4, line 17, that portion of the formula reading "$k_{\sim}$" should read --$k_{||}$--;

" " " " that portion of the formula reading "$v_{\sim}$" should read --$v_{||}$-- column 4, line 62, "Eqs. (8)" should read --Eqs. (8a,b,c)-- column 4, line 63, "u=NE" should read --$u=N\xi$-- column 5, line 22, "$H/G<(27/32)^{\frac{1}{3}}$." should read --$H/G\lesssim(27/32)^{\frac{1}{3}}$.-- column 5, line 22, "$H/G\lesssim(27/32)^{\frac{1}{3}}$ Eq." should read --$H/G<(27/32)^{\frac{1}{3}}$ Eq.-- column 5, line 36, "$k_{\sim}$" should read --$k_{||}$-- column 5, line 58, "$k_{\sim}$" should read --$k_{||}$-- column 5, line 62, "$v_{\sim}$" should read --$v_{||}$-- column 5, line 64, "$k_{\sim}$" should read --$k_{||}$--

Column 6, line 60, that portion of the formula reading "$\beta_{\sim}$" should read --$\beta_{||}$--

UNITED STATES PATENT AND TRADEMARK OFFICE

CERTIFICATE OF CORRECTION

PATENT NO. : 4,480,234 Page 3 of 3

DATED : October 30, 1984

INVENTOR(S) : Jonathan M. WACHTEL

It is certified that error appears in the above-identified patent and that said Letters Patent is hereby corrected as shown below:

column 8, line 15, "$v_{\sim}$" should read --$v_{||}$-- column 8, line 30, "claim 2," should read --claim 1,--

Signed and Sealed this

*Nineteenth* Day of *November 1985*

[SEAL]

*Attest:*

DONALD J. QUIGG

*Attesting Officer* *Commissioner of Patents and Trademarks*